United States Patent [19]

Inculet

[11] Patent Number: 4,514,289

[45] Date of Patent: Apr. 30, 1985

[54] METHOD AND APPARATUS FOR SEPARATING PARTICULATE MATERIALS

[75] Inventor: Ion I. Inculet, London, Canada

[73] Assignee: Blue Circle Industries PLC, London, England

[21] Appl. No.: 551,916

[22] Filed: Nov. 15, 1983

[30] Foreign Application Priority Data

Nov. 17, 1982 [GB] United Kingdom ..... 8232853

[51] Int. Cl.[3] ..... B03C 7/04

[52] U.S. Cl. ..... 209/127.3; 209/128

[58] Field of Search ..... 209/1, 127 R, 127 A, 209/127 B, 128–131; 204/164, 180 R, 186

[56] References Cited

U.S. PATENT DOCUMENTS

| | | | |
|---|---|---|---|
| 2,699,869 | 1/1955 | Gear | 209/127 |
| 2,848,108 | 8/1958 | Brastad et al. | 209/127 B |
| 2,848,727 | 8/1958 | Johnson | 15/1.5 |
| 3,162,592 | 12/1964 | Pohl | 209/127 R |
| 3,401,795 | 9/1968 | Tauveron | 209/127 R |
| 3,489,279 | 1/1970 | St. John | 209/130 |
| 3,720,312 | 3/1973 | Shook et al. | 209/127 B |
| 3,739,554 | 6/1973 | Whetten et al. | 209/127 R |
| 3,853,750 | 12/1974 | Volsy | 209/127 R |
| 4,357,234 | 11/1982 | Inculet et al. | 209/128 |

FOREIGN PATENT DOCUMENTS

| | | | |
|---|---|---|---|
| 464,598 | 4/1950 | Canada | 204/128 |
| 1,025,688 | 4/1966 | United Kingdom | 209/128 |
| 464,598 | 4/1950 | United Kingdom | 204/130 |

*Primary Examiner*—Howard S. Williams
*Assistant Examiner*—Terryence Chapman
*Attorney, Agent, or Firm*—Brooks Haidt Haffner & Delahunty

[57] ABSTRACT

Particles having different properties (e.g. particulate fly ash and carbon) are separated by moving the particles forwards along a horizontal electrode plate (1) above which is mounted a second electrode (2) having two plates (4) each extending sideways from a central block (3) of dielectric material at an acute angle ($\alpha$) to the horizontal. An alternating electric field is generated between the electrodes (1, 2) by a high voltage AC power source (14). The field lines (16) from each plate curve to the side and impart centrifugal forces to particles charged by friction or conductive induction, which forces separate lighter, more highly charged particles from the others. The separated particles are collected in bins (13) arranged around the lower electrode (1), which electrode is mounted on a vibratory transducer (12).

21 Claims, 4 Drawing Figures

METHOD AND APPARATUS FOR SEPARATING PARTICULATE MATERIALS

FIELD OF THE INVENTION

The present invention relates to a method and to an apparatus for separating particles having different properties, in particular to such a method and apparatus whereby electrostatic separation of the particles is effected by means of an alternating electric field.

BACKGOUND TO THE INVENTION

Many techniques are available in industry for the separation of the components of a mixture of particulate solids. For example, where the materials to be separated differ substantially in particle size, separation may be achieved using screens or sieves. In cases where the components of the mixture differ in density, it may be possible to achieve separation using a fluidized bed or by means of froth-floation. Electrostatic separators are also known, which use high voltage fields to attract or repel particles in order to effect separation of materials whose particles differ substantially in the electric charges acquired through various electrification processes.

British Patent Specification No. 2,099,729A and the corresponding U.S. Pat. No. 4,357,234, (the teaching of which documents is incorporated herein by reference) describe an electrostatic method and an apparatus that can be used to separate particles that have different physical properties, for example conductivity, mass, size or density.

The said method comprises the steps of charging the particles; and driving the particles in a forward direction through an alternating electric field—in particular a field of non-uniform intensity in a direction perpendicular to the forward direction—having field lines curved in the perpendicular direction whereby the particles are subjected to a centrifugal force in the perpendicular direction, the centrifugal force on each particle being dependent on the mass, size and electric charge of the particle whereby different particles are separated along the perpendicular direction.

The said apparatus comprises means for generating an alternating electric field having a predetermined length and width, wherein the field lines are curved in the direction of the width of the field; means for inserting the particles into one end of the electric field at the side away from the curvature of the field lines; and means for driving the particles through the electric field along the length of the electric field.

In a preferred form, that apparatus comprises a first electrode in the form of a metallic plate mounted on a conventional vibratory feeder.

A second electrode, also in the form of a metallic plate, is mounted above the first electrode at an acute angle (typically 12°) thereto in a lateral direction. In operation, the electrodes are connected to a high voltage AC source which produces an alternating electric field between the electrodes. The field lines are curved, owing to the inclination of the second electrode with respect to the first.

A chute is arranged to deliver a mixture of particulate materials on to the upper surface of the first electrode at one end thereof and adjacent the side where there is the least separation between the first and second electrodes.

The vibratory feeder is so arranged as to transport particles along the length of the first electrode.

The particles moving along the length of the first electrode will acquire charges owing to triboelectrification and/or conductive induction. The curved field lines impart a circular motion to the charged particles which has the effect of subjecting those particles to a centrifugal force. Thus the particles will tend to move in a lateral direction, specifically in the direction in which the two electrodes diverge.

The higher the charge on a particle (compared with otherwise similar particles), or, for equal charges, the smaller or less dense the particle is, the greater will be the motion in the said lateral direction. For example, if pulverised fly ash (PFA) contaminated with carbon is fed to the apparatus, the heavier, less charged fly ash particles will deviate little from the path determined by the vibratory feeder, whereas the lighter, more highly charged carbon particles will tend also to be moved in a lateral direction under the influence of the alternating field. Bins or other receptacles are placed at appropriate points with respect to the first electrode for the collection of PFA-rich fractions and carbon-rich fractions.

Although the above-described apparatus represented a significant advance in the art, it has since been found that its operation can be improved in a number of respects. One drawback of the apparatus as described is the high intensity and lack of uniformity of the field at the side where there is the least separation between the two electrodes. The intensity of the field in this region gives rise to a risk of electrical breakdown (sparking) between the electrodes and, furthermore, can hinder the clean separation of the components of the mixture to be separated.

Another drawback is the spillage of unseparated material at the side of the apparatus where the distance between the two electrodes is smallest; baffles could be used to prevent such spillage but they would provide a surface leakage path leading to breakdown between the electrodes.

SUMMARY OF THE PRESENT INVENTION

The present invention now provides a method of separating particles having different physical properties, which comprises generating an alternating electric field; introducing the particles into the field; charging at least some of the particles; and causing the particles to move along the field in a given direction; characterised in that the electric field has a first region having field lines curved in a first direction generally perpendicular to said given direction and has a second region having field lines curved in a second direction generally perpendicular to said given direction, whereby a charged particle acted upon by the electric field in either of the first and second regions is subjected to a force in the respective first or second direction. The force on the particle tends to separate that particle along that perpendicular direction from particles having different properties.

In general, the said first and second directions are generally opposite to each other, transversely of the said given direction. Preferably, the said first and second directions are disposed at an angle of from $\pi \pm 0.05$ to $\pi \pm 0.56$ radians, typically $\pi \pm 0.17$ radians, to each other.

The invention also provides an apparatus for separating particles having different properties, which comprises means for generating an alternating electric field;

means for introducing the particles into the field; and means for causing the particles to move along the field in a given direction; characterised in that the means for generating the electric field is such that the electric field has a first region having field lines curved in a first direction generally perpendicular to said given direction and has a second region having field lines curved in a second direction generally perpendicular to said given direction. Usually, the electric field-generating means and the particle-moving means will be sufficient to ensure that at least some of the particles are charged by conductive induction and/or triboelectrification; however, the provision of additional particle-charging means is not excluded herein.

Preferably, the apparatus is such that the field-generating means comprises a first electrode means providing a first surface; the particle-introducing means is arranged to deliver the particles unto the said first surface of the first electrode means; the particle-moving means is adapted to move the particles along the said first surface in a given direction; and the field-generating means also comprises a second electrode means, providing a second surface and a third surface, and power source means adapted to apply an alternating potential difference between the first and the second electrode means and produce an alternating electric field extending between the said first surface and the said second and third surfaces. The second surface diverges from the first surface to one side of the apparatus, whereas the third surface diverges from the first surface to the other side of the apparatus.

BRIEF DESCRIPTION OF THE DRAWINGS

In the Figures, like parts are indicated by like numerals.

DESCRIPTION OF THE PREFERRED EMBODIMENTS

Figure 1:
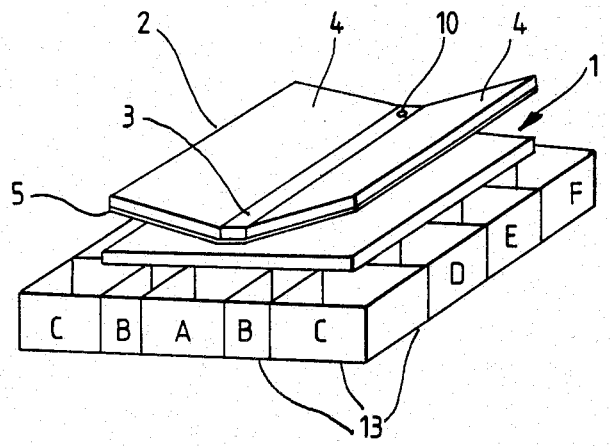
FIG. 1 is a diagram showing, in perspective, the arrangement of the electrodes in an apparatus of the present invention and showing the disposition of receptacles for collecting fractions of materials separated by means of the apparatus.

The exemplary embodiment shown in Figures 1–4 comprises a first electrode means 1 in the form of a conductive plate of generally rectangular plan, which plate is mounted substantially horizontally. A second electrode means 2 is mounted above the first electrode means 1 and is spaced from it.

The second electrode means 2 comprises a central member 3 in the form of an elongate block having a substantially rectangular cross-section, the central member extending parallel to the first electrode means in the lengthwise direction. Extending from each of the two long sides of the central member 3 is a wing in the form of a conductive plate 4. The lowermost surface of the electrode means 2 (i.e. the surface facing the first electrode means) is provided with a layer 5 of dielectric material.

Each plate 4 is substantially rectangular in plan and has a substantially planar lower surface 6 which subtends an angle $\alpha$ (preferably up to 0.56 radian, especially from 0.10 to 0.28 radian) to the planar upper surface 7 of the first electrode means 1. Thus, the second electrode means has an "inverted roof" structure with the central member 3 at its apex, the two surfaces 6 being disposed at an angle of $\pi+2\alpha$ radians to each other. (Disposing the surfaces 6 at an angle to each other of $\pi-2\alpha$ radians would place the central member 3 uppermost, instead of as illustrated.)

A mixture of particulate materials to be separated may be delivered from a hopper or funnel 8 which communicates via conduit 9 with a bore 10 extending vertically through the central block 3 at one end of the latter. To ensure a proper flow of the material through the conduit 9, a vibratory feeder 11, for example a Syntron (trade mark) feeder, is provided. Of course, an alternative feed device could be used, for example a screw conveyor or an auger feeder.

Material passing through the bore 10 in the central block 3 will fall onto the upper surface 7 of the first electrode means at one end thereof. The first electrode means is mounted on a vibratory transducer 12 (see FIG. 2), e.g. a Syntron device, which is adapted, in operation, to drive the material falling onto the surface 7 from bore 10 in a direction towards the other end of the surface 7 (the "forward direction"). Of course, other means could be employed to move the particulate material along the plate in the forward direction. Bins 13, or other suitable receptacles, are provided and are so placed as to collect particulate material falling over the front edge and side edges of the plate constituting the first electrode means 1.

In operation, a potential difference is applied between the first electrode means and the second electrode means. In the illustrated embodiment, a high-voltage, alternating current power source 14 is connected to each plate 4 of the second electrode means 2 (see FIG. 3), whereas the first electrode means 1 is grounded (earthed) as indicated at 15. The potential difference will generate an electric field between the first and the second electrode means. In the region of the electric field between the first electrode means and each plate 4, the field lines 16 will be curved (see FIG. 4) owing to the inclination of that plate 4 relative to the first electrode means 1. As shown, the field lines from either plate 4 curve in a direction perpendicular to the forward direction, i.e. the convex sides of the lines face in the transverse direction in which that plate 4 diverges from plate 1.

Figure 4:
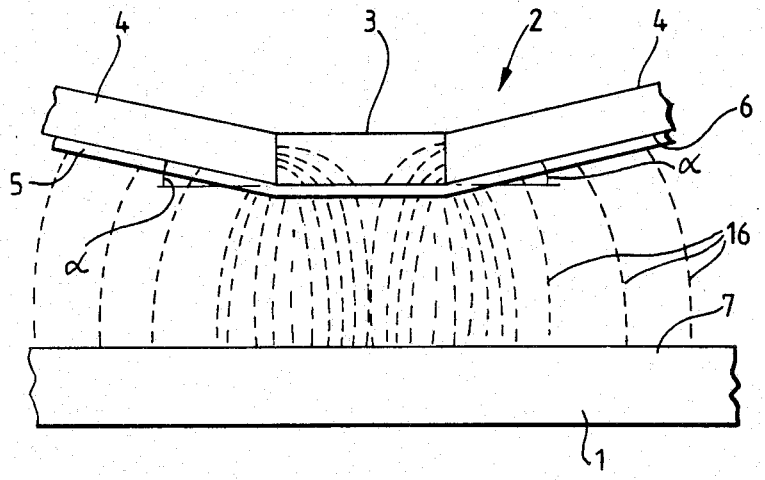
FIG. 4 is a diagram showing part of the electrodes, as seen from the front, and indicating the field lines between the electrodes in operation.

The permittivity of the material of the central member 3 being greater than that of air, the electric field lines emerging from the innermost edges of the plates 4 will, in general, first penetrate the central member 3 and then descend substantially vertically towards the first electrode means 1 (as shown diagrammatically in FIG. 4). Thus, the field lines between the regions under plates 4 will generally be rectilinear. Nevertheless, it has been found in practice that the particles, during their passage along the first electrode means 1, tend to spread out and sufficient will enter a region of curved electric field lines for effective separation to occur. Thus, the central member 3 helps to effect a gradual introduction of particulate material into the two "centrifugally active" regions of the electric field.

The applied potential difference requied for the best result can be readily determined in any case, having regard to the nature of the materials to be separated and the dimensions of the electrode means. The potential difference may be typically within the range of 5 to 30 kV. An appropriate frequency for the power source may also be readily determined for any given case. The frequency will generally be up to 100 Hz, and is typically within the range from 5 to 60 Hz. It has been found that the larger the dimensions of the apparatus, the more suitable are the lower frequencies.

The first and the second electrode means may be fabricated from any appropriate material, provided that the first electrode surface 7 and the plates 4 are conductive. Metals, e.g. bronze, copper, aluminum or steel, may be employed. It is particularly important that the upper surface 7 of the first electrode means should remain conductive; thus, a material such as stainless steel is preferred to a material such as aluminium, which may be susceptible to oxidation.

The purpose of the dielectric layer 5 on the underside of the second electrode means 2 is to reduce the likelihood of electrical breakdown between the first and second electrode means. The relative permittivity (compared to air) of the layer material will generally be 3 or more, typically from 3 to 7. Although, in principle, most insulating materials could be employed (including glass, mica or porcelain), it is preferred for ease of fabrication that the layer material should have good moulding properties. Materials which have proved suitable include natural and synthetic elastomers as well as synthetic resins (plastics), for example silicone rubber, polyamides (e.g. Nylon), epoxy resins, polyesters and fibreglass/polyester composites.

The central member 3 can be fabricated from any of the dielectric materials suitable for the layer 5.

As indicated above, the vibratory transducer 12 serves to drive the particulate material falling onto the plate 1 from the bore 10 in a forward direction. However, in order to inhibit the particles from sticking to one another and to the surface 7 of the lower electrode, the stream of moving particles may be subjected to pulsed jets of gas. In the illustrated embodiment, a slot-shaped nozzle is positioned at the point indicated by 17 (FIG. 2) to direct a pulsed air stream along the upper surface 7 of the first electrode means 1 in the forward direction below the central member 3. Furthermore, the central member 3 may be drilled with a series of small holes (not shown) which may be connected to a pulsed air supply in order to direct intermittent jets of air towards the upper surface 7 of the first electrode means.

Other means, for example rappers (not shown), may be provided to remove material that adheres to the electrode surfaces during operation, should the accumulation of such material prove to be a problem.

Figure 3:
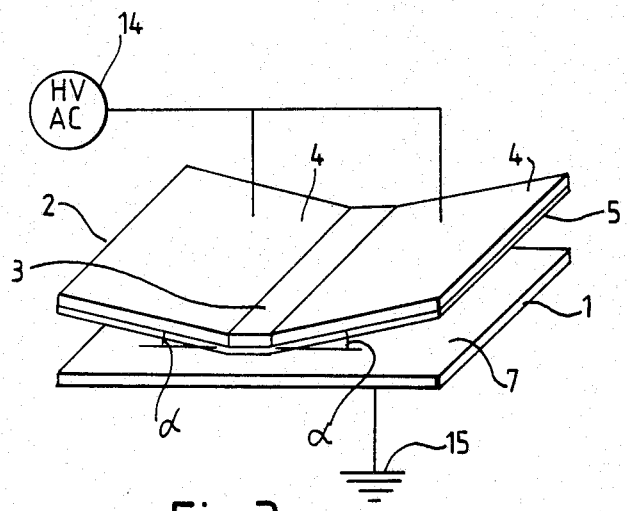
FIG. 3 is a diagram similar to that in FIG. 1, but indicating the electrical connection of the electrode system to the power source.

It will be understood, of course, that various elements (such as the material supply means 8, 9, 10, 11, the vibratory transducer 12 and the collecting bins 13) have been omitted from FIGS. 3 and 4 for the sake of clarity.

The operation of the apparatus may be described, by way of an example, with reference to the beneficiation of pulverized fly ash (PFA) contaminated with carbon particles. The contaminated PFA is dumped in the funnel or hopper 8, the power source 14 is connected to the electrode means and the plate constituting the lower electrode 1 is set into vibratory motion by switching on the vibratory transducer 12. The feeder 11 is then switched on in order to convey a stream of the contaminated PFA through the conduit 9 and bore 10 onto the upper surface 7 of the first electrode means 1. The stream of particulate material is then moved in the forward direction by the vibratory transducer 12. Particle individualisation is increased and sticking of the particles is decreased by means of pulsed air currents supplied through the nozzle at 17 and through the series of holes drilled in the central member 3 of the upper electrode means 2.

The carbon particles tend to become much more highly charged than the particles of fly ash. Accordingly, the carbon particles are subjected to a greater electrostatic force by the electric field. The oscillatory motion of the carbon particles under the electrostatic force will tend to follow the field lines, which, being curved in a direction perpendicular to the forward direction, will result in a centrifugal force on the carbon particles in that perpendicular direction. Thus, whereas the main mass of fly ash will tend to remain below the central member 3 as it moves along the surface 7, the carbon particles will be urged by the said centrifugal force (or the transverse component thereof) in a lateral direction. As a result, the bins A, B and C (see FIG. 1) will receive ash-rich fractions, whereas the bins D, E and F will receive carbon-rich fractions.

It is possible, of course, to subject the collected fractions to one or more further separating operations using the apparatus of the invention. By means of such a multi-stage separation procedure, it is possible to obtain the desired component or components with a higher degree of purity.

The invention is not limited to the separation of carbon from PFA. In general, it is applicable to the separation of components of a mixture of particulate materials that so differ in properties that one component will be subjected to a significantly higher centrifugal force in the curved electric field. Accordingly, the invention can be used to separate a conductive component from an insulating component, or to separate components that differ significantly in particle mass, size or density.

It will be apparent that the illustrated embodiment can be modified in numerous respects. For example, instead of having just the lower layer 5 of dielectric material, it would be possible to have the electrode plates 4 entirely embedded in, or encapsulated by, an envelope of dielectric material. This may reduce even further the possibility of electrical breakdown. It will be appreciated that any measure that reduces the risk of electrical breakdown will permit the use of higher voltages and/or of shorter distances between the electrodes.

Although, in principle, the plates 4 could be joined at their inner edges, the provision of an intermediate member such as the central block 3 is greatly preferred for two reasons. Firstly, owing to the inclination of the plates 4, the field strength increases as the distance between the plate 4 and the first electrode surface 7 decreases. The central member 3, being of dielectric material, reduces the likelihood of electrical breakdown in the region where there is minimum separation between the first and the second electrode means. Secondly, the size and shape of the cross-section of the central member or block 3 may be selected in order to obtain a desired configuration of field lines below the apex of the second electrode means.

Thus, the cross-section of the central member 3 could, for example, be square, circular, parabolic, elliptic, hyperbolic, crescent-shape or triangular instead of the rectangular shape as illustrated. The effect of any given cross-sectional shape on the configuration of the electric field lines beneath the central section can be readily determined, empirically or by calculation.

In the illustrated embodiment the vertical projection of the second or upper electrode means and that of the first or lower electrode means are substantially identical. However, this is not essential and either means cold extend beyond the other in a given direction. For example, it may be convenient to deliver the particulate mixture, by means of a chute or the like, directly to the upper surface of a part of the first electrode means that extends rearwardly of the upper electrode means. In such a case, it may be found desirable to provide the upper electrode wings with a rearwardly extending isolated metal plate in order to modify the pattern of field lines to ensure that the entry of the particulate mixture into the electric field is not hindered.

Although the plates 4 in the illustrated embodiment are planar, it would be possible for each plate to have a cross-section which followed a curve, provided that the plate still diverged from the upper surface of the lower electrode in order to maintain the curvature of the electric field.

Furthermore, it is not essential to have the upper surface of the lower electrode disposed horizontally. For example, it would be possible to have the upper surface tilting up or down at either side of the longitudinal central line of the first electrode means 1 (i.e. a line immediately below the central member 3). Thus, a shallow V-shape could assist in the retention of the heavier particles on the central portion of the lower electrode during their passage along it. It is also possible to arrange the lower electrode means so that the upper surface thereof slopes downwards in the forward direction; such an arrangement permits the transport of the particles to be assisted by gravity. The angle of slope is in general up to 45°, preferably about 18°, with respect to the horizontal.

It would also be possible to provide a layer of dielectric material on the upper surface 7 of the lower electrode means 1, especially in cases where adequate charging of the particles can be achieved by triboelectrification or ion or electron bombardment (i.e. in cases where conductive induction is not required for particle charging).

As illustrated, the electric field has a substantially constant cross section in the forward direction and, indeed, this is at present preferred. However, the electrodes could be so arranged as to increase or decrease that cross-section in the forward direction and thereby decrease or increase the field intensity in that direction. Similarly, there may be cases where it is appropriate to have the plates 4 disposed at different angles to the upper surface 7 of the lower electrode.

It is possible to dispense with the receptacles D, E and F by providing a wall or other barrier at each side edge of the first electrode means 1. The barrier will serve to restrain the more highly charged particles from further lateral movement, although such particles will still be driven in the forward direction. Thus, when using such a modified apparatus for the beneficiation of carbon-contaminated PFA, the carbon particles will tend to accumulate at each of the barriers, the resultant carbon-rich fraction being discharged into the receptacles C (FIG. 1).

In preferred embodiments the upper surface of the first electrode means 1 is provided by a gas-permeable plate formed, for example, of a sintered metal such as bronze. The gas-permeable plate may constitute the top of a plenum chamber into which a gas, conveniently air, is passed under pressure. The gas will pass through the gas-permeable plate and will fluidise the particles being driven along the upper surface thereof.

As mentioned above, means other than a vibratory transducer may be employed in order to move the particles along the first electrode means in the required direction. The use of a gas-permeable plate as described above permits the particles to be moved along the plate by the simple expedient of having the plate slope downwards in the forward direction, as mentioned above. The gas passing through the gas-permeable plate will diminish the frictional resistance of the upper electrode surface 7 to the movement of particles across it, thereby permitting the particles to move forward under the force of gravity. An electrostatic separator that is provided with such a gas-permeable plate is described in greater detail in the co-pending patent application Ser. No. 551,869 claiming priority from British patent application No. 8232857; the teachiing of the aforesaid co-pending application is incorporated herein by reference.

In preferred embodiments, the electrode arrangement is such that the potential across the first region of the electric field and across the second region of the electric field will vary with distance along the respective perpendicular direction. It has been found that such an arrangement may increase the curvature of the field lines, thereby improving the separation of the particles. Thus, as described in detail in the co-pending patent application Ser. No. 551,810 claiming priority from British patent application No. 8232855—the teaching of which co-pending application is incorporated herein by reference—each electrode wing 4 may be constituted by a body of conductive material of high resistance, the edge of which that is closest to the first electrode means being held at a higher electrical potential than the edge that is furthest from the first electrode means. Conveniently, the body of conductive material may be formed by a volume of oil doped with one or more metal salts, the oil being contained within a box of dielectric material.

Alternatively, each electrode wing 4 may be formed by a series of two or more conductive plates, each plate being separated from the next plate in the series by dielectric material, each plate being held at a respective electric potential so that the potential across the electrode wing 4 decreases in a stepwise manner in the direction towards the outermost edge thereof.

When a large quantity of material has to be separated, it may be found more efficient to distribute it to several separators of moderate size rather than use a separator of large dimensions.

The present invention is illustrated in and by the following Examples.

EXAMPLE 1

Figure 2:
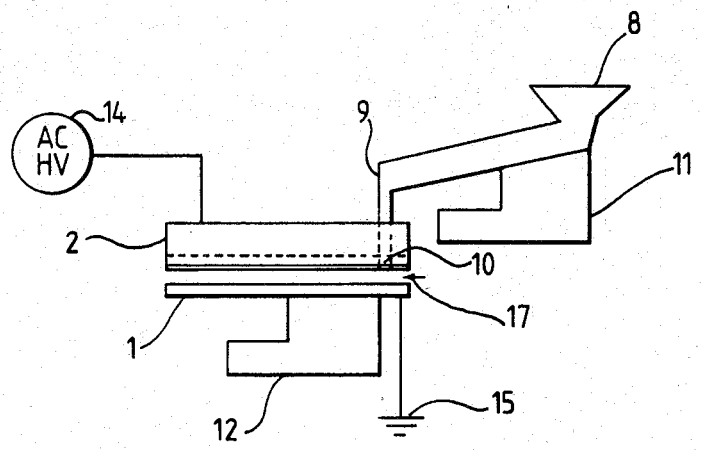
FIG. 2 is a diagram indicating the components of an apparatus according to the invention, as seen in a side view.

An apparatus was constructed as shown in FIGS. 1–2, the apparatus being positioned within an enclosure in order to permit stabilisation of the air humidity and temperature. The lower electrode plate 1, made of an aluminium alloy, was approximately 30 cm long and 25 cm wide and was disposed horizontally. The two electrode plates 4, also made of an aluminium alloy, were symetrically disposed to either side of a central block 3 that was about 2 cm wide. The dielectric layer 5 was of polycarbonate, as was the central block 3, whilst the upper electrode means was surmounted by a layer of acrylic resin.

The experiments were carried out in series of five or six, using standardised samples of carbon-contaminated PFA. The carbon content in the standardised samples of contaminated PFA was 16.6±0.5% by weight.

Before each series of experiments, the apparatus was vacuum cleaned in order to remove any PFA adhering to the electrodes. The distance between the electrodes and the angle therebetween were fixed before each experiment. The generator providing the AC field comprised means for selectively varying the frequency of the field from 10 to 200 Hz. Having selected the appropriate frequency, the power supply, pulsed air source and an electrode rapper were switched on.

taminated PFA from the funnel 8 into the electrostatic separator.

The conveyor speed was defined as the velocity of the PFA travelling over the lower electrode plate. To measure this, a batch of approximately 10 grams of PFA was placed at the rear end of the lower electrode plate and the time required to discharge the batch at the other end of the electrode plate was recorded. No field was applied during the measurement of the conveyor speed (calculated by dividing the length of the lower electrode plate by the measured time).

The operating conditions and parameters are summarised in the following table.

TABLE 1

| Series | 1 | 2 | 3 | 4 | 5 | 6 | 7 | 8 |
|---|---|---|---|---|---|---|---|---|
| Frequency (Hz) | 20 | 20 | 20 | 30 | variable | 50 | variable | 20 |
| Angle (rad) | 0.19 | 0.19 | 0.19 | 0.22 | 0.22 | 0.25 | 0.25 | 0.28 |
| Electrode Separation (mm) | 10.4 | 10.4 | 10.4 | 10.4 | 10.4 | 8.1 | 8.1 | 5.3 |
| Temperature (°C.) | 22 | 5 | 3 | −3 | 3 | 21 | 22 | 40 |
| Relative Humidity (%) | 28 | 38 | 33 | 28 | 33 | 11 | 22 | 10 |
| Feedrate (g/s) | 2.0 | 2.0 | 2.0 | 2.0 | 2.0 | 2.0 | 2.0 | 1.8 |
| Conveyor speed (cm/s) | 2.6 | 2.6 | 2.6 | 2.6 | 2.6 | 2.5 | 2.2 | 2.0 |
| Moisture in sample (%) | 0.15 | 0.15 | 0 | 0 | 0.15 | 0 | 0.15 | 0.15 |
| Voltage (kV) | variable | variable | variable | variable | 12 | variable | 11 | variable |
| Variable | 9 | 9 | 9 | 10 | 10 | 8 | 10 | 7 |
| | 10 | 10 | 10 | 11 | 15 | 9 | 20 | 8 |
| | 11 | 11 | 11 | 12 | 20 | 10 | 30 | 9 |
| | 12 | 12 | 12 | 13 | 30 | 11 | 40 | 10 |
| | 13 | 13 | 13 | 14 | 40 | 12 | 50 | 11 |
| | 14 | 14 | 14 | — | 50 | 13 | 60 | 12 |

A 100-gram test sample of the contaminated PFA was placed in the funnel and the associated vibratory feeder was switched on, as was the vibratory feeder on which the lower electrode plate was mounted.

The individual fractions were collected, labelled, weighed and stored for subsequent analysis. Symetrically collected samples (i.e. samples collected in the bins marked with the same reference letter in FIG. 1) were mixed together in order to reduce the number of analyses required.

The pulsed air supply was set at 1 pulse per 1.7 s for all experiments.

The significant operating parameters and conditions were recorded for each experiment.

The applied voltage was taken as the root mean square value, measured at the upper electrode means.

The angle measured was that subtended by one of the upper electrode plates 4 at the upper surface 7 of the lower electrode plate 1 in a vertical plane perpendicular to the forward direction.

The electrode separation was measured as the vertical distance between the upper surface 7 of the lower plate 1 and the lowermost side of the central member 3 of the upper electrode means.

The relative humidity of the air and the temperature were measured inside the above-mentioned enclosure.

The moisture content of the sample was measured according to the ASTM standard No. D3173-73. About 5 grams of the sample was dried for 2 hours in a vacuum oven at 105° C., and the resultant loss of weight in grams was then measured.

The carbon content of a sample was measured according to the ASTM standard No. D3174-73. About 1 gram of the sample was dried for 2 hours in a vacuum oven at 105° C., and the sample was burned for 3 hours at 750° C. in a porcelain crucible of 35 $cm^3$ volume. The resultant loss of weight in grams was then measured.

The feedrate was calculated from the time required for the vibratory feeder 11 to feed a given mass of con- For each experiment, a fly ash beneficiation curve was constructed, in which the carbon content in the extract (expressed as a percentage) was plotted against the mass extracted (also expressed as a percentage). The "carbon content in the extract" is defined as the cumulative change in weight after ashing divided by the cumulative sample weight extracted. The "mass extracted" is defined as the cumulative weight of sample extracted divided by the total sample weight extracted.

The carbon content in the extract was plotted as the ordinate (y axis) against the mass extracted plotted along the abscissa (x axis).

The beneficiation curves constructed from the experimental data showed an increase in carbon content with increasing mass extracted. However, the curve for each experiment was in general almost flat up to a certain point, indicating only a very slight increase in carbon content against increasing mass extracted. Above that point (hereinafter termed the "change point"), the curve became much steeper, indicating a rapid rise in the carbon content in the extract.

The initial experiments in each series were clearly anomalous, in that the resultant curves showed, for 100% mass extracted, a carbon content in excess of the carbon content in the original sample. The source of error was traced to an accumulation of a relatively carbon-free layer of PFA on the lower and upper electrodes. The accumulation stabilised in general by the beginning of the third experiment in each series. In evaluating the data, the anomalous experiments were disregarded.

The curves showed change points of at least 60% mass extracted, the majority of the curves being practically flat up to a figure of 70% or more. These results indicate that it should be possible in most cases to extract at least 70% of the processed raw material before the carbon concentration starts to increase significantly.

EXAMPLE 2

Beneficiated PFA obtained as described in Example 1 was subjected to a further separating process in the apparatus as described in Example 1, thereby simulating the second stage of a multi-stage separating process.

Four experiments were carried out, using different operating conditions. The beneficiated PFA from each experiment was subjected to a further pass through the apparatus, thereby simulating the third stage of a multi-stage separating process. The source of the sample used in each third-stage experiment was beneficiated PFA collected in bins A and B in one of the second-stage experiments.

The operating parameters and conditions are summarised in Table 2 below.

TABLE 2

| | 2nd stage | 3rd stage |
|---|---|---|
| Frequency (Hz) | variable | 20 |
| Voltage (kV) | variable | 9 |
| Angle (rad) | 0.24 | 0.24 |
| Electrode Separation (mm) | 11.4 | 11.4 |
| Temperature | 22 | 22 |
| Relative Humidity (%) | 22 | 23 |
| Feedrate (g/s) | 2.0 | 2.0 |
| Conveyor speed (cm/s) | 2.6 | 2.6 |
| Moisture in sample (%) | 0.15 | 0.15 |
| Carbon content in sample (%) | 12.5 | ca 10 |
| Variable | 20 Hz, 9 kV<br>20 Hz, 13 kV<br>50 Hz, 13 kV<br>50 Hz, 9 kV | Source of the sample |

The reprocessing of PFA through multi-stage experiments showed the process to become increasingly selective. The central portions of the conveyor (i.e. the portions discharging into bins A and B) retained an increasing percentage of the total processed mass, as can be seen from the table which follows.

TABLE 3

| | First stage | Second stage | Third stage |
|---|---|---|---|
| Ash-rich fraction (Bins A and B) | 87% | 90% | 96% |
| Percent carbon in Extract | 12% | 9% | 8% |

EXAMPLE 3

Four further experiments were carried out using an apparatus and a procedure substantially as described in Example 1. Samples of carbon-contaminated PFA having a carbon content of 16.6±0.5% were employed.

The operating parameters and conditions are summarised in the following table.

TABLE 4

| | Experiment No. | | | |
|---|---|---|---|---|
| | 1 | 2 | 3 | 4 |
| Frequency (Hz) | 20 | 20 | 20 | 20 |
| Voltage (kV) | 12 | 12 | 12 | 9 |
| Angle (rad) | 0.2 | 0.2 | 0.2 | 0.2 |
| Electrode Separation (mm) | 10.2 | 10.2 | 10.2 | 10.2 |
| Temperature (°C.) | 23 | 23 | 23 | 23 |
| Relative Humidity (%) | 28 | 28 | 28 | 28 |
| Feedrate (g/s) | 0.56 | 0.11 | 0.28 | 0.28 |
| Conveyor Speed (cm/s) | 1.2 | 2.6 | 2.6 | 2.6 |
| Moisture in Sample | 0.15 | 0.15 | 0.15 | 0.15 |

Beneficiation curves were constructed from the data, in the manner described in Example 1. The first experiment showed a change point at 50% mass extracted, but the result was deemed to be anomalous. The second, third and fourth experiments all yielded beneficiation curves having a change point in excess of 60% mass extracted.

I claim:

1. A method of separating particles having different physical properties, which comprises generating an alternating electric field; introducing the particles into the field; charging at least some of the particles; and causing the particles to move along a path in the field in a given direction; characterized in that the electric field has a first region having field lines curved convexly in a first direction away from said path and generally perpendicular to said given direction and has a second region having field lines curved convexly in a second direction away from said path and generally perpendicular to said given direction, whereby a charged particle acted upon by the electric field in either of the first and second regions is subjected to a centrifugal force in the respective first or second direction.

2. A method according to claim 1, characterised in that charging of the particles is effected by triboelectrification and/or by conductive induction.

3. A method according to claim 1 or 2, characterised in that the particles are driven along the field by mechanical vibration.

4. A method according to claim 1 or 2, characterised in that the particles are fluidized within the electric field to permit them to move along the field under the force of gravity.

5. A method according to claim 1 or 2, characterised in that the said first and second directions are generally opposite to each other transversely of the said given direction.

6. A method according to claim 1, characterised in that the particles are introduced into the electric field at a point between the said first and second regions of that field.

7. A method according to claim 1, characterised in that the first and second regions of the field are separated by a further region in which the field lines are substantially rectilinear.

8. A method according to claim 1, characterised in that the electric field oscillates at a frequency of up to 100 Hz.

9. A method according to claim 1, wherein the alternating electric field is generated between the two electrode means by a potential difference of from 5 to 30 kV.

10. An apparatus for separating particles having different properties, which comprises means for generating an alternating electric field; means for introducing the particles into the field; means for charging at least some of the particles; and means for causing the particles to move along the field in a given direction; characterised in that the field-generating means is arranged to generate an electric field which has a first region having field lines curved convexly in a first direction generally perpendicular to said given direction and has a second region having field lines curved convexly in a second direction generally perpendicular to said given direction.

11. An apparatus according to claim 10, wherein the field-generating means comprises a first electrode means; the particle-charging means is a first surface provided by the first electrode means, which first surface is conductive; the particle-introducing means is arranged to deliver the particles unto the said first surface of the first electrode means; the particle-moving means is adapted to move the particles along the said first surface in a given direction; and the field-generating means further comprises a second electrode means, providing a second surface and a third surface, and power source means adapted to apply an alternating potential difference between the first and second electrode means and produce an alternating electric field extending between the said first surface and the said second and third surfaces; characterised in that the second surface diverges from the first surface to one side of the apparatus and in that the third surface diverges from the first surface to the other side of the apparatus.

12. An apparatus according to claim 11, characterised in that the said first surface of the first electrode means is substantially planar.

13. An apparatus according to claim 11 or 12, characterised in that the said first surface of the first electrode means slopes downwards in the said given direction and is defined by a gas-permeable plate, means being provided for passing gas up through the gas-permeable plate at a rate to fluidize particles on the said first surface so that they move in the given direction under the force of gravity.

14. An apparatus according to claim 11 characterised in that the first surface of the first electrode means is substantially horizontal.

15. An apparatus according to claim 11, characterised in that the particle-driving means is a vibratory transducer on which the first electrode means is mounted.

16. An apparatus according to claim 11, characterised in that the said second and third surfaces are each substantially planar.

17. An apparatus according to claim 16, characterised in that the second and third surfaces are each defined by a respective conductive plate, the said surfaces being disposed at an angle of more than $\pi$ radians to each other.

18. An apparatus according to claim 17, characterised in that the said plates are arranged as wings extending from either side of an elongate member formed of a dielectric material.

19. An apparatus according to claim 18, characterised in that the elongate member has a surface opposite to and parallel with the said first surface of the first electrode means.

20. An apparatus according to claim 16, characterised in that the said second surface and the said third surface each diverge from the said first surface at an angle of from 0.10 radians to 0.28 radians.

21. An apparatus according to claim 11, characterised in that the said second and third surfaces of the second electrode means are provided with a layer of a dielectric material.

* * * * *